US005347898A

United States Patent [19]

Ito

[11] Patent Number: 5,347,898

[45] Date of Patent: Sep. 20, 1994

[54] SYSTEM FOR ASSORTING SMALL PRODUCT PIECES CUT FROM WORK PIECES

[75] Inventor: Masaoki Ito, Hadano, Japan

[73] Assignee: Amada Company, Limited, Japan

[21] Appl. No.: 975,975

[22] Filed: Nov. 13, 1992

Related U.S. Application Data

[63] Continuation of Ser. No. 709,814, Jun. 4, 1991, abandoned.

[30] Foreign Application Priority Data

Jun. 5, 1990 [JP] Japan ..... 2-145383

[51] Int. Cl.[5] ..... B21D 28/06; B26D 7/32

[52] U.S. Cl. ..... 83/27; 83/35; 83/39; 83/112; 83/151; 83/160; 83/945

[58] Field of Search ..... 83/27, 35, 39, 112, 83/151–154, 160, 255, 404, 945; 414/792.9; 209/539, 903

[56] References Cited

U.S. PATENT DOCUMENTS 3,982,453 9/1976 D'Amato et al. ..... 83/23
4,230,004 10/1980 Jonson ..... 83/23
4,546,683 10/1985 Volkel et al. ..... 83/27
4,833,954 5/1989 Jenkner ..... 83/27

FOREIGN PATENT DOCUMENTS 0266619 11/1988 European Pat. Off. .
1133625 11/1987 Japan .
63-38028 10/1988 Japan .
1432475 4/1976 United Kingdom .
2193918 2/1988 United Kingdom .

*Primary Examiner*—Hien H. Phan
*Attorney, Agent, or Firm*—Wigman, Cohen, Leitner & Myers

[57] ABSTRACT

A method and system for assorting a number of small product pieces (G) cut off from a large work sheet (W) which is processed by a cutting machine (1) to form small product parts (G). The system includes a cutting-off device (71) for cutting off the small product parts (G) in turn from the large work sheet (W), transportation device (9) for transporting the small product pieces (G) cut off from the sheet (W) in a direction (X) and positioning the pieces (G) in desired places in the transportation device (9), and an assorting device (11) for collecting the pieces (G) at the desired places and positioning the pieces in predetermined places by every kind of the pieces (G).

8 Claims, 10 Drawing Sheets

SYSTEM FOR ASSORTING SMALL PRODUCT PIECES CUT FROM WORK PIECES

This is a continuation-in-part of co-pending application Ser. No. 07/709,814 filed on Jun. 4, 1991, now abandoned.

BACKGROUND OF THE INVENTION

1. Field of the Invention

The present invention relates to a method and a system for assorting a number of small product pieces cut off from large work sheets.

2. Description of the Prior Art

In conventional processing for cutting a large work sheet by a machine to form a plurality of and several kinds of small product parts in the work sheet, the large sheet is cut so that the small product parts are still connected to the work sheet through remaining small uncut parts of contour lines of the product parts. Then, the large work sheet are removed from the machine, and the small product parts are punched and separated from the large work sheet by man power. After it, the small product pieces are assorted by man power by every kind.

In another conventional process for separating the small product parts from the large work sheet, the remaining small uncut parts of the contour lines of the small product parts are punched by a cutter disposed on or beside the cutting machine.

Accordingly, it requires man power at least to assort the small product pieces.

SUMMARY OF THE INVENTION

It is therefore an object of the present invention to provide a method and a system for automatically assorting the small product pieces by every kind.

The method of the present invention for assorting small product pieces cut off from a large work sheet includes following steps:

(a) cutting a work sheet by a cutting machine to form a plurality of and several kinds of small product parts which are connected to the work sheet through remaining small uncut parts of contour lines of the small product parts, (b) cutting the remaining small uncut parts of the contour lines of the small product parts in turn, (c) passing small product pieces cut off from the work sheet in a transportation direction to transportation device disposed beside the cutting machine, (d) transporting the small product pieces in the direction and positioning the small product pieces in desired places by the transportation means, and (e) collecting the small product pieces at the desired places and assorting automatically the small product pieces in desired positions by every kind.

The method is, for example, characterized in that the small product pieces are stopped at a place in the transportation direction and moved in a direction perpendicular to the transportation direction up to the desired places by the transportation device.

The method is, for example, characterized in that the work sheet is gripped by clampers during the cutting by the cutting machine, and after the cutting by the cutting machine the small product parts are cut off from the work sheet by a cutting-off device automatically without re-gripping of the work sheet by the clampers.

The method is, for example, characterized in that the small product pieces are carried to the transportation device through a table disposed in front of the cutting machine and movable in the perpendicular direction for receiving the small product pieces in turn cut off from the work sheet and passing the small product pieces to the transportation device.

According to the method of the present invention, a number of small product parts are cut off automatically from a work sheet of large size, and collected and assorted by every kind. Furthermore, the small product pieces obtained are of high precision because the work sheet has being clamped by the clampers without re-gripping under same condition during the process for cutting by the cutting machine and cutting off by the cutting-off device.

The system of the present invention for assorting a number of small product pieces cut off from work sheets associates with a cutting machine which cuts a work sheet to form a plurality of small product parts which are connected to the work sheet through remaining small uncut parts of contour lines of the small product parts. The system includes following devices:

(a) a cutting-off device for cutting the remaining small uncut parts, (b) transportation device disposed beside the cutting-off device for carrying small product pieces in turn cut off from the work sheet in a transportation direction and positioning the small product pieces in desired places, and (c) an assorting device for collecting the small product pieces at the desired places and positioning the small product pieces in desired places.

The system is, for example, characterized in that the system further comprises a table disposed adjacent to the cutting-off device and movable in a direction perpendicular to the transportation direction for receiving the small product pieces in turn cut off from the work sheet and passing the piece on a transportation path which passes the cutting-off device up to the transportation device before receiving next piece.

According to the system of the present invention, the small product parts are cut off from the work sheet automatically by the cutting-off device successively after cutting by the cutting machine and moved in the transportation direction to the transportation device. Then, the pieces are positioned in desirable places and moved further to the assorting device by means of the transportation device and are collected and assorted in desirable places by the assorting device.

DESCRIPTION OF THE PREFERRED EMBODIMENTS

Now embodiments of the present invention will be described in detail with reference to attached drawings.

Figure 1:
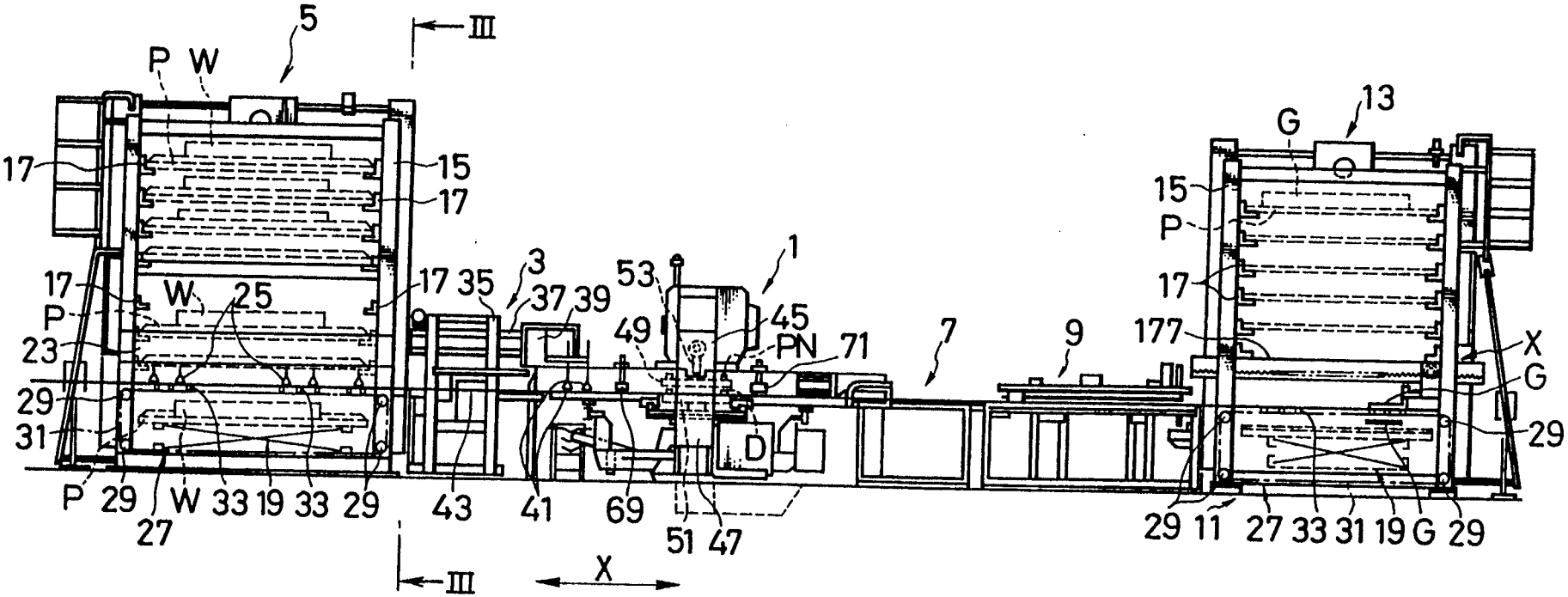
FIG. 1 is a front view of a work sheet processing line including a system of the present invention for assorting many small product pieces cut off from a large work sheet.
Figure 2:
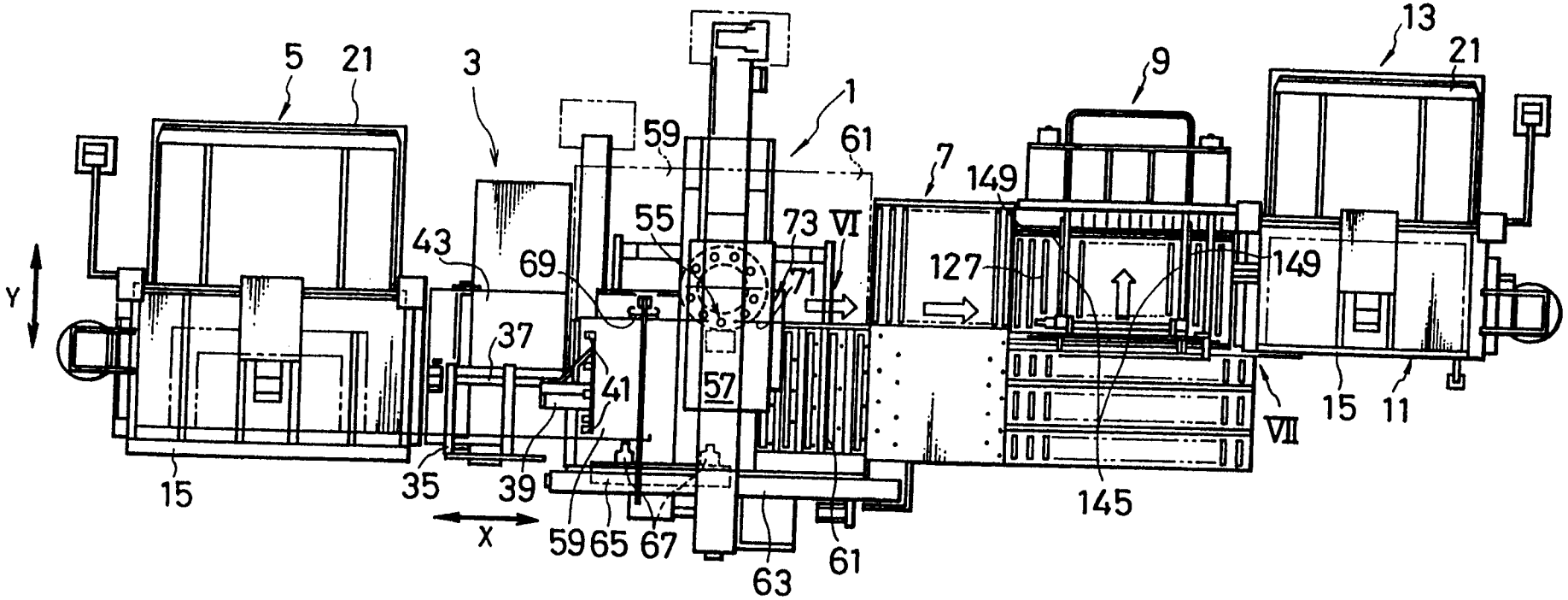
FIG. 2 is a plan of the processing line shown in FIG. 1.

In FIGS. 1 and 2, a processing line for cutting a large work sheet W into many small product pieces G and for assorting the pieces G is shown.

First, an outline for the processing line is described. At a nearly central part of the processing line, a machine 1 for cutting work sheets W is installed. In this example, a turret punch press 1 is used as a cutting machine. However, the machine may be a laser beam cutting machine or else. A material sheet W of large size is cut with the machine 1 to form many small product parts G1, G2, G3, G4, G5 and G6 (FIG. 5) which are still connected to the sheet W through small parts A, B, C, D, E, F, H and K remaining uncut of contour lines of the small product parts G. A loading device 3 for providing the turret punch press 1 with the material sheet W is disposed on the left of the press 1, and an autostorage 5 is disposed on the left of the loading device 3 for storing a large number of material sheets W and passing the material sheets W sheet by sheet to the loading device 3.

On the other hand, a cutting-off device 71 is disposed at a place 73 on the right of the press 1. The device 71 cuts the remaining uncut parts A, B, C, D, E, F, H and K in turn to cut off the small product parts G from the sheet W. On the right of the cutting-off device 71, a transportation table 61 movable forwards and backwards, that is, in a direction Y, is disposed for receiving the small product pieces G cut off from the sheet W in turn and passing the product pieces G to transportation means 9 disposed on the right of the transportation table 61 through an auxiliary table 7. The transportation means 9 carries the pieces G from the left to the right in a direction X perpendicular to the direction Y, and also places the pieces G in each appropriate position in the direction Y. An autostorage 13 is disposed on the right of the transportation means 9 for collecting and assorting the positioned small product pieces G.

Now structures and functions of devices or means of the processing line are explained in detail.

Figure 3:
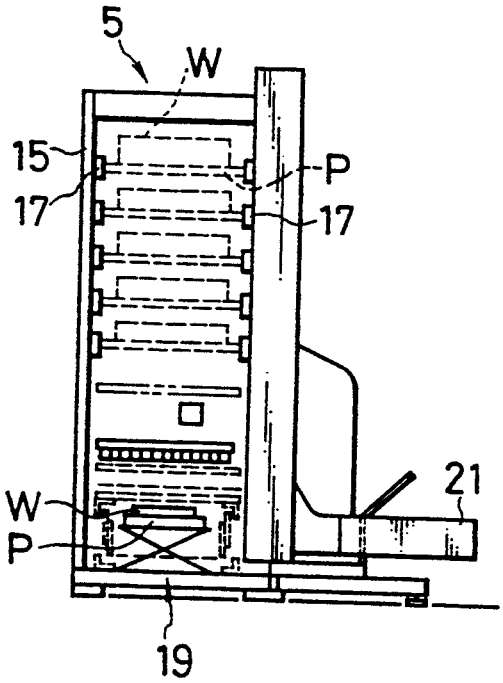
FIG. 3 is a side view taken on an arrow III in FIG. 1.

As shown in FIGS. 1–3, the autostorage 5 includes a frame structure 15 in an upper part of which a plurality of receiving devices 17 are disposed at different heights for receiving pallets P. A plurality of material sheets W are piled on each pallet P supported by the receiving device 17. The autostorage 5 also have a lifter 19 at the foot of the frame structure 15 and an elevator 21 behind the lifter 19. The elevator 21 carries the pallets P to and fro between the receiving device 17 and the lifter 19.

In order to provide the cutting machine 1 with a material sheet W, first, the elevator 21 is moved up and stopped at a height of one of the receiving devices 17 to withdraw and place a pallet P on it, and then moved down to the lifter 19 to push the pallet P onto the lifter 19.

Transverse members 23 are fixed to the frame structure 15, and suction cups 25 are mounted on the transverse members 23 so that the suction cups can move vertically above the lifter 19. A slat conveyor 27 is also installed at the foot of the frame structure 15 as shown in FIG. 1. The slat conveyor 27 has a pair of a plurality of sprocket wheels 29 around each pair of which a chain 31 runs. Some slats 33 are bridged partly between the chains 31.

After loading of the pallet P from the receiving device 17 on the lifter 19 which lift the pallet P to a determined position, the chains 31 are run counterclockwise to clear the slats 33 from a space between suction cups 25 and the lifter 19. Then the suction cups 25 are moved downwards to suck and take up a material sheet W from a pile of the sheets up to a height, and then the chains 31 are run clockwise to position the slats 33 above the lifter 19. Next, the suction cups are moved down and disactivated to place the sheet W on the slats 33 of the slat conveyor 27. Then, the suction cups 25 are raised, and the chains 31 are run clockwise for passing the sheet W to the loading device 3.

When all the material sheets W are passed to the loading device 3 and no sheet is left on the pallet P, the pallet is withdrawn from the lifter 19 and returned to a receiving device 17 in the frame structure 15 by means of the elevator 21, and another pallet is carried from a receiving device 17 on to the lifter 19.

Explanation is omitted here about detailed structures of the elevator 21, the receiving device 17 and the lifter 19 for passing and receiving the pallet P among them since such structures are known in the prior art.

Now, the loading device 3 is explained with reference to FIG. 1. The loading device 3 include a frame structure 35 on which a loader guide 37 extended in the direction X is mounted for guiding a loader 39 . The loader 39 is movable in the direction X along the guide 37 and provided with suction cups 41 movable vertically. The frame structure 35 is provided with a supporting table 43 for receiving and supporting the material sheet W from the autostorage 5. The loading device 3 is indicated in Japanese Patent Y63-38028A and known. Therefore, detailed explanation is omitted here about the device.

The loader 39 is moved leftwards until it comes above the material sheet W received from the autostorage 5 and now being on the supporting table 43, and then, the suction cups 41 are lowered to suck and lift the material sheet W up to a predetermined height. The loader 39 is then moved rightwards to the turret punch press 1, and the suction cups 41 are lowered and disactivated to pass the material sheet W to the press 1.

As shown in FIGS. 1 and 2, the turret punch press or cutting machine 1 has an upper and a lower frames 45 and 47 by which an upper and a lower turrets 49 and 51 are supported respectively in a rotatable manner. A number of punches PN and associated dies D are disposed in circumferential areas of the turrets 49 and 51 respectively. A striker 53 is mounted on the upper frame 49 above the turrets 49, 51 and is activated by driving means (not shown) for hitting a punch PN at a punching place 55. The turrets 49, 51 are rotatable to position a desirable combination of a punch PN and die D in the punching place 55 and right under the striker 53.

A center table 57 is fixed in front of the punching place 55, and a frontal side table 59 and a transportation table 61 are disposed on the left and the right of the center table 57 respectively. A carriage base 63 is mounted on frontal ends of the frontal side table 59 and the transportation table 61 so that the carriage base 63 and the two tables 59, 61 are integrated into a body. The tables 59, 61 are integrally movable with the carriage base 63 in the direction Y along at least one guide rail 91 (FIG. 6) disposed under the tables 59, 61 and extended in the direction Y. A carriage 65, which has clampers 67, is mounted on the carriage base 63 movably in the direction X.

The material sheet W from the loading device 3 is gripped on a frontal end by the clampers 67 at an end of the sheet W and moved many times in the directions X, Y by moving the tables 59, 61 with the carriage base 63 and the carriage 65 to place the parts required to be punched of the sheet W between the punch PN and the die D at the punching place 55. The sheet W is pressed by a pressing device 69 disposed on the left of the press 1 and the cutting-off device 71 on the right of the press to stable the sheet when subjected to punching by the turret punch press 1.

The tables 59, 61 and the carriage 65 are operated by driving devices (not indicated in the drawings) such as motors, screws and so on. Detailed descriptions about gripping the sheet W introduced from the loading device 3, moving the tables 59, 61 in the direction Y, and moving the carriage 65 with the clampers 67 in the direction X are omitted here since these are well known.

Figure 4:
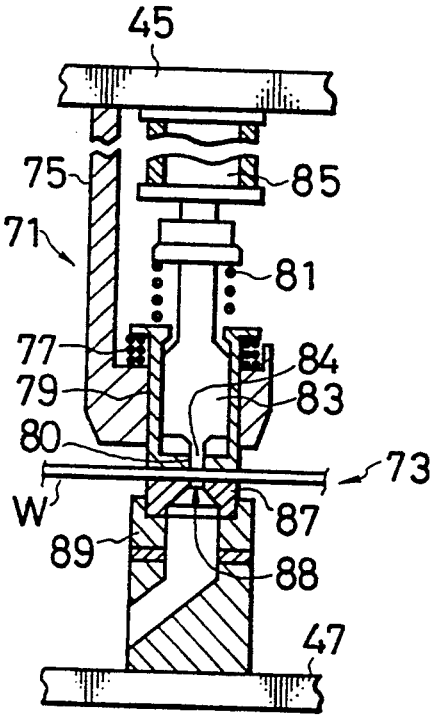
FIG. 4 is a section of a cutting-off device of the system for cutting off each small product part from the large work sheet.

Cutting-off of the small product parts G from the work sheet W is carried out at the place 73 adjacent to the press 1 by using the cutting-off device 71 which is shown in FIG. 4 in detail. The work sheet W gripped by the clampers 67 is moved appropriately in the directions X and Y after punching by the press 1, so that the small product parts G are cut off in turn.

In FIG. 4, the cutting-off device 71 is mounted on the press 1, for example, on the upper and lower frames 45 and 47 of the press 1. A punch holder 75 is suspended from the upper frame 45, while a die holder 89 is supported on the lower frame 47.

A hollow cylinder 79 is supported movably in a vertical direction in the punch holder 75 through a coil spring 77 of low rigidity disposed on the punch holder 75. The hollow cylinder 79 penetrates the bottom of the punch holder 75. An opening 80 is formed in the bottom part of the hollow cylinder 79. A fluid cylinder 85 is also suspended from the upper frame 45. The fluid cylinder 85 has a piston rod, and a punch 83 is supported by a free end of the piston rod. The punch 83 has a tip 84 and is guided in the hollow cylinder 79. A coil spring 81 of high rigidity is disposed between the punch 83 and the hollow cylinder 79.

On the other hand, a die 87 is supported on the die holder 89, and an opening 88 is formed in the die 87. The opening 88 is continued to a hole disposed in the die holder 89.

Accordingly, the spring 77 of low rigidity shrinks first when a fluid under low pressure is supplied in the fluid cylinder 85, and the hollow cylinder 79 presses the work sheet W against the die 87. A remaining uncut part A, B, C, D, E, F, H or K is under the hole 80. Then, the pressure of the fluid in the cylinder 85 is increased, and therefore, the punch 83 is lowered by the pressure while the coil spring 81 of high rigidity is shrunk. The tip 84 of the punch goes through the hole 80 and punches out the uncut part A, B, C, D, E, F, H or K which drops into the hole 88 in the die 87. A number of small product pieces G cut off from the work sheet W in turn are received by the table 61 disposed on the right of the place 73.

During the processing of cutting the work sheet W at the place 55 to form the small product parts G and cutting off the parts from the sheet W at the place 73, the work sheet W has been gripped by the clampers 67 from the beginning without re-gripping. Therefore, the products pieces G obtained are of high precision.

Figure 6:
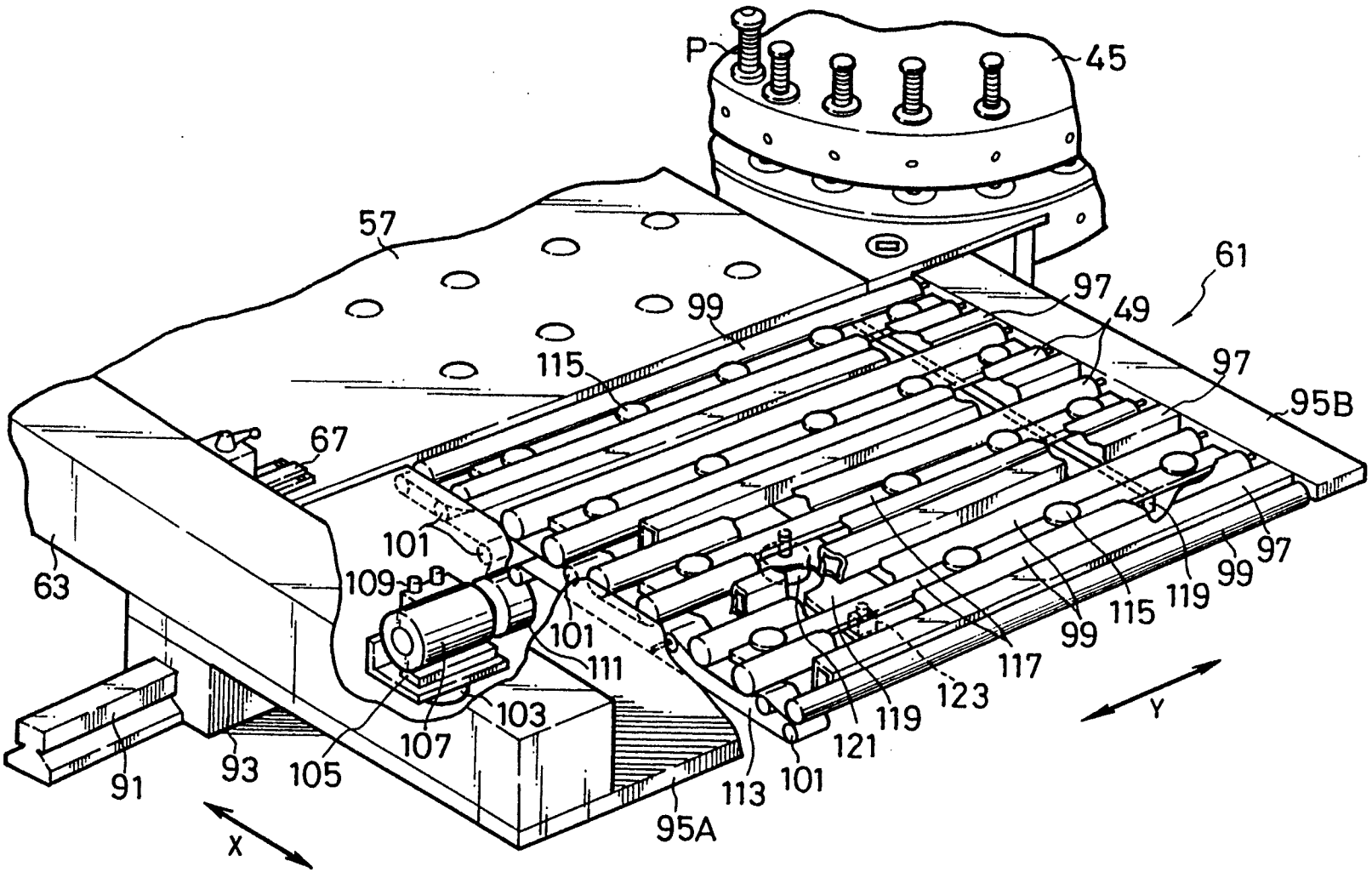
FIG. 6 is an enlarged perspective view of a part of the system indicated by an arrow VI in FIG. 2.

In FIG. 6, the transportation table 61 is in the most frontal position in the direction Y, and the cutting-off device 71 is omitted. The most rear position of the table 61 is shown in FIG. 2 by an imaginary line. The table 61 adjacent to the cutting-off device 71 receives the small product piece G cut off from the sheet W.

The guide rail 91 is supported by the lower frame 47. A slider 93 is mounted on the guide rail 91 in a slidable manner along the guide rail 91 extended in the direction Y. Two frames 95A and 95B extended in the direction X are spaced and integrally fixed to the slider 93, and frames 97 extended in the direction Y are bridged between the two frames 95A and 95B and spaced in the direction X. Rollers 99 are disposed between the frames 97. Both ends of each roller 99 is supported by the frames 95A and 95B respectively in a rotatable manner.

A plurality of idlers 101 are disposed under frontal ends of rollers 99 and are supported by the frame 95A in a rotatable manner. A fluid cylinder 103 is disposed under the idlers 101, and a motor 107 is mounted on the fluid cylinder 103 through a bracket 105. The bracket 105 is moved with the motor 107 along two rails 109 which extend in a vertical direction by actuating the fluid cylinder 103. A pulley 111 is attached to a driving axis of the motor 107, and an endless belt 113 Is disposed around the pulley 111 and the idlers 101 and under the rollers 99. Crowning is applied to the idlers 101 to concentrate the force on the center of the endless belt 113, so that the belt 113 is prevented from meandering and is put in stable running.

To transport the small product pieces G, the cylinder 103 is actuated first to lower the motor 107 along the guide rails 109. In the result, the belt 113 is tensioned. Then, the motor 107 is driven and the rollers 99 are rotated clockwise to transport the product pieces G rightwards.

During the cutting-off of the small product parts G from the work sheet W at the cutting-off place 73, the rollers 99 are rotated. Therefore, a small product piece G on the table 61 is discharged quickly to the auxiliary table 7 before next one is cut off. The auxiliary table 7 is the same as the transportation table 61 in structure. The path of the product piece G from the transportation table 61 to the auxiliary table 7 is shown by big arrows in FIG. 2.

However, the motor 107 is raised, and the endless belt 113 is not tensioned when the work sheet W is subjected to punching by the press 1 at the place 55. Accordingly, the belt 113 and the rollers 99 are not rotated. The reason is to avoid interference such as vibration and so on in the carriage base 63 by the actuated belt 113 and rollers 99.

A plurality of supporting bases 117 are disposed between the transportation rollers 99 and extended in the direction Y. Each supporting base 117 has a plurality of supporting rollers 115 of which top surfaces can move up and down with respect to surfaces of the transportation rollers 99. The supporting bases 117 are fixed to two guide bases 119 spaced in the direction Y and extended in the direction X. The guide bases 119 are supported by four fluid cylinders 121 lower ends of which are fixed to a base supported on the floor. Totally four linear bushings 123 are attached to every end of the guide bases 119. In FIG. 6, only one fluid cylinder 121 and linear bushing are shown.

When the work sheet W is subject to punching by the press 1 at the place 55, the fluid cylinders 121 are activated and the supporting bases 117 are raised to support the sheet W in parts by supporting rollers 115. Therefore, the sheet W is prevented from shifting and vibrating. The linear bushings 123 prevent the supporting rollers 115 from vibrating when the punch press 1 is in action, and also keep the rollers 115 in predetermined position.

When small product pieces G are carried on the transportation table 61, the supporting rollers 115 are lowered, and the product pieces G are supported on the rollers 99 and discharged from the table 61.

Figure 7:
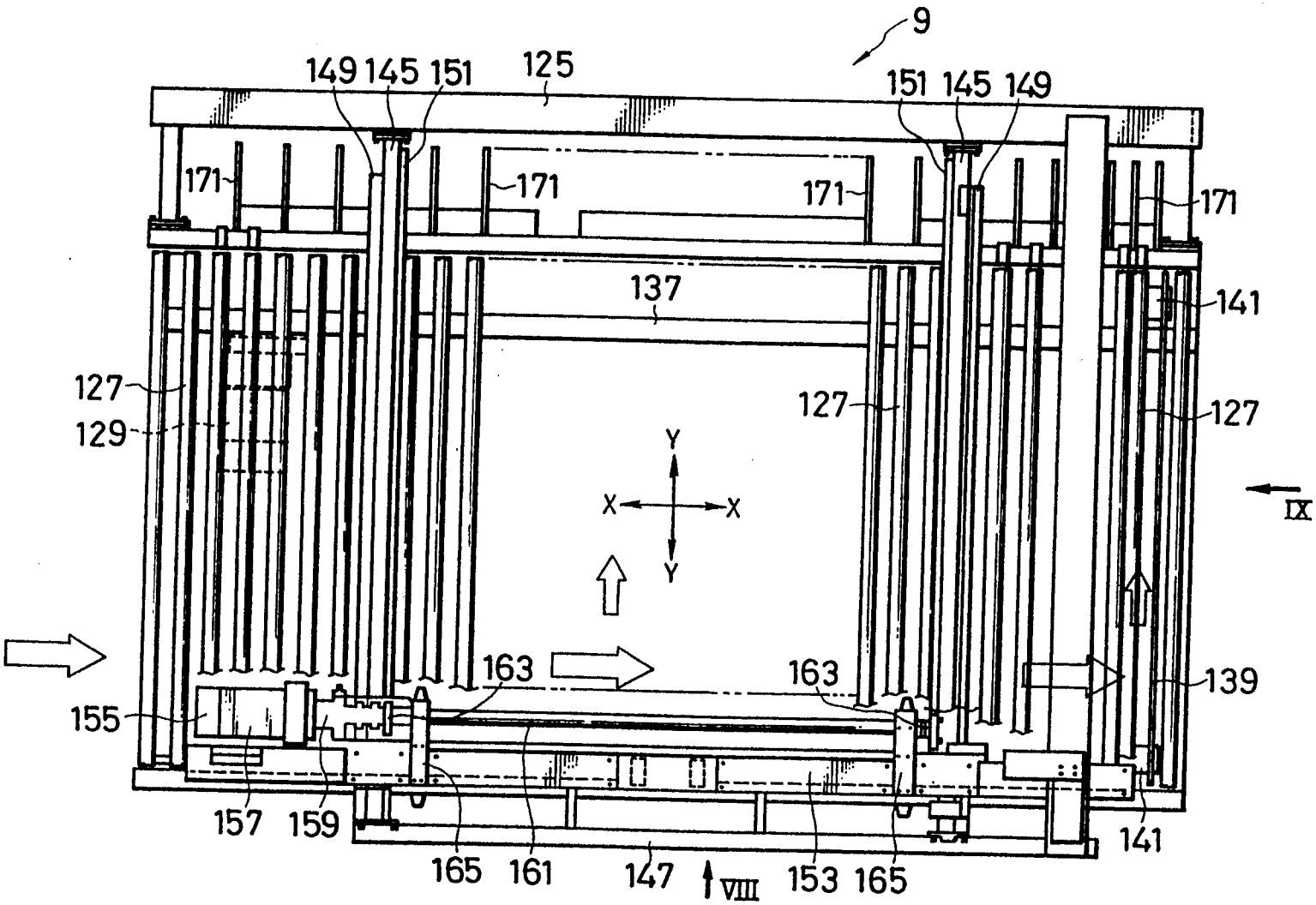
FIG. 7 is an enlarged plan of a part of the system indicated by an arrow VII in FIG. 2.
Figure 8:
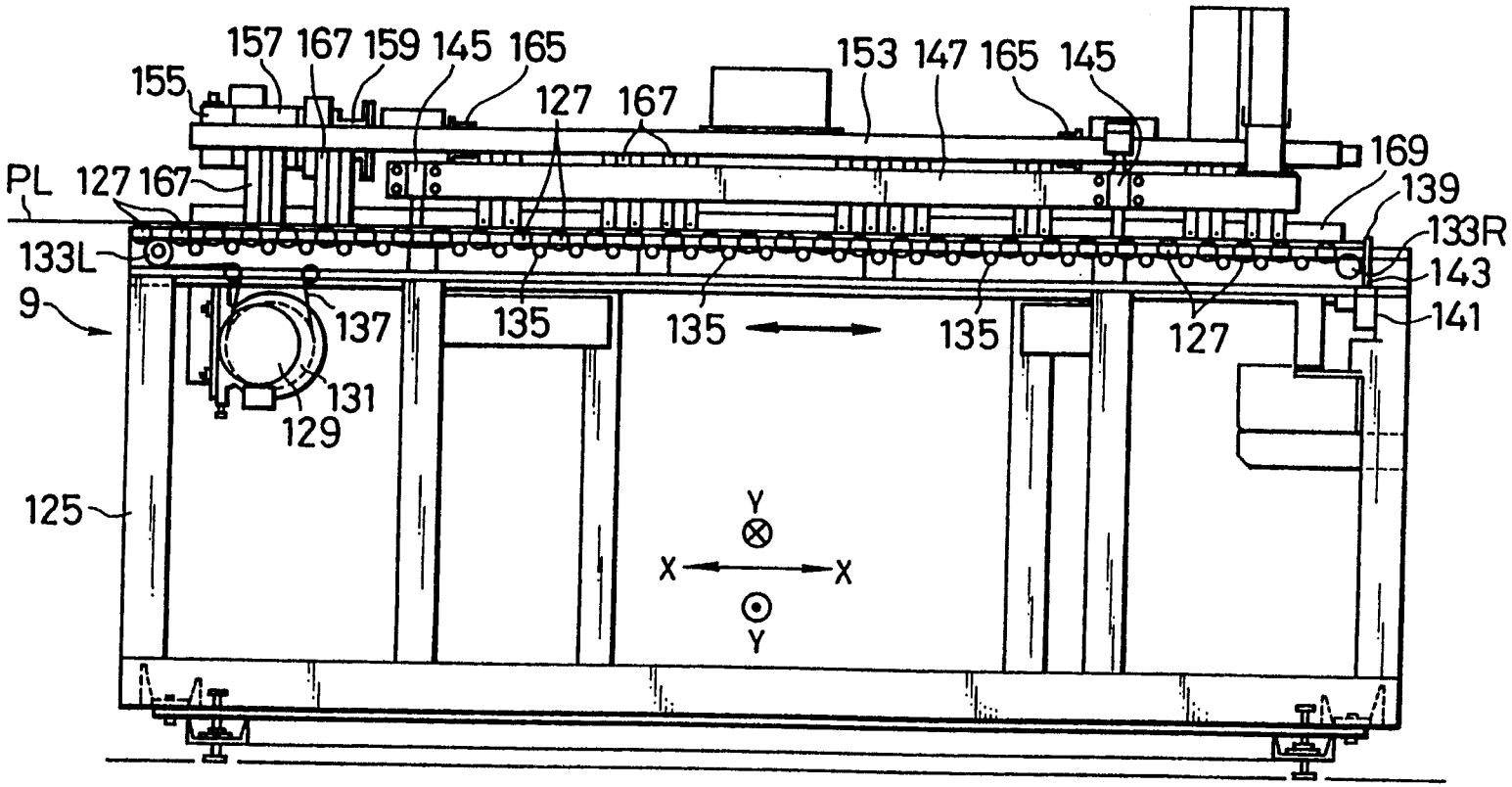
FIG. 8 is a front view taken on an arrow XIII in FIG. 7.
Figure 9:
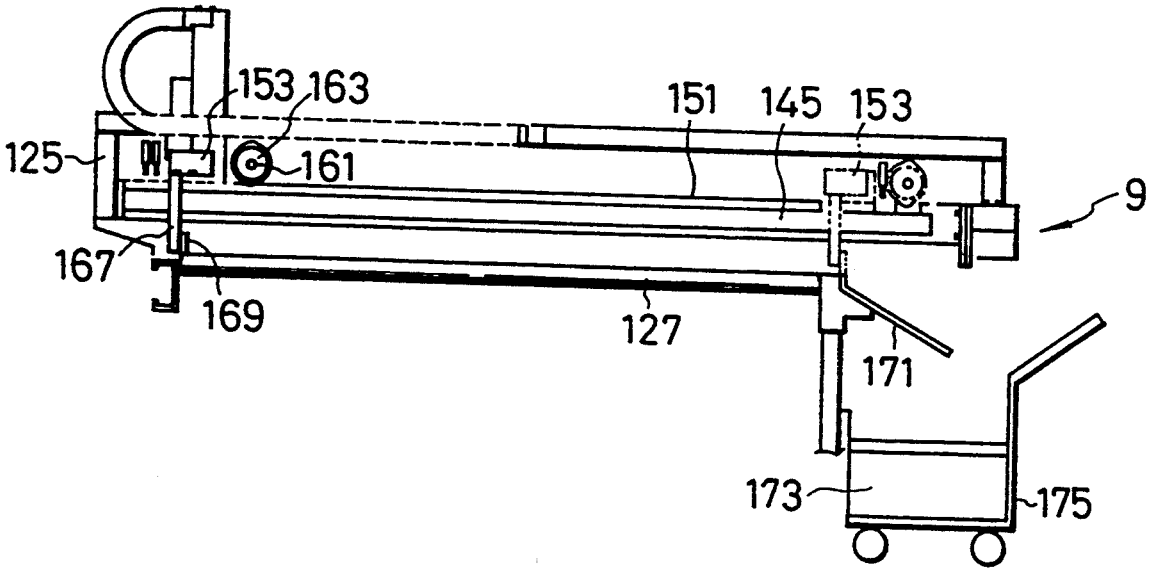
FIG. 9 is a side view taken on an arrow IX in FIG. 7.

In FIGS. 7–9, the small product transportation means 9 is shown. The means 9 receives the small product pieces G from the auxiliary table 7. The means 9 includes a frame structure 125 on which a plurality of pipe rollers 127 are mounted in a rotatable manner. The pipe rollers 127 extended in the direction Y are spaced in the direction X and descended gradually towards right (FIG. 8). That is, a roller on the right is at a lower level than a roller on the left. A motor 129 is supported on the frame structure 125 for rotating the rollers 127. A pulley 131 is attached to a driven axis of the motor 129.

At both ends of the frame 125 (FIG. 8), idler pulleys 133R, 133L are disposed in a rotatable manner. Furthermore, a plurality of idler rollers 135 are disposed between the pipe rollers 127 in a rotatable manner. An endless friction belt 137 is disposed around the pulley 131 and the idler pulleys 133R, 133L. The belt 137 is guided between upper surfaces of the idler pulleys 133R, 133L and lower surfaces of the pipe rollers 127 and is in contact with the surfaces so that friction is caused between the belt 137 and the surfaces.

Accordingly, the belt 137 is rotated anticlockwise when the motor is driven so that the pulley 131 of the motor is rotated anticlockwise. Therefore, the pipe rollers 127 are rotated clockwise, and small product pieces G are carried on the rollers 127 rightwards.

A stopper 139 is mounted on the frame 125 at the end in the direction X. The stopper 139 is extended in the direction Y and is movable up and down with respect to the level of the path line PL. A cylinder 141 is mounted on the frame 135 for lifting the stopper 139. The cylinder has a piston rod 143 to a free end of which a lower end of the stopper 139 is fixed.

Accordingly, the product pieces G carried from the left are stopped at the stopper 139 when the cylinder 141 is activated and the stopper 139 is lifted above the level of the path line PL. The piece G does not return to the left when it contacts the stopper 139 since the path line PL is descended towards right.

If necessary, the stopper 139 is lowered below the level of the path line PL, and the product pieces G are carried rightwards furthermore.

Two guide rails 145 are mounted on the frame 125. The guide rails 145 are extended in the direction Y and spaced in the direction X. Ends, for example, frontal ends of the guide rails 145 are supported by a plate 147. Two linear guides 149 extended in a direction Y are disposed outside the both guide rails 145, while racks 151 extended in a direction Y are disposed inside the guide rails 145. A loader 153 extended in a direction X is mounted on the linear guides 149. A plurality of blocks 167 spaced in a direction Y are fixed to the loader 153, and a pusher 169 is mounted on lower ends of the blocks 167.

A motor 157 such as a servo motor which has an encoder 155 is mounted on an end of the loader 153. The motor 157 has an axis 161 extended in a direction X and rotatably supported on two bearings 165 fixed to the loader 153. A moderator 159 is disposed between the motor 157 and the axis 161. The axis 161 is provided with pinions 163 which are engaged with the racks 151.

Accordingly, the loader 153 is moved in a direction Y along the racks 151 when the motor 157 is driven and the axis 161 is rotated. Therefore, the pusher 169 is moved backwards in the direction Y to push the product piece G stopped at the stopper 139 up to a predetermined position. The displacement of the piece G or the loader 153 in the direction Y is detected by the encoder 155.

By the way, a plurality of inclined bars 171 spaced in the direction X are disposed in the rear of the rollers 127, and scraps from the work sheets W are cleared from the transportation means 9 by the pusher 169 through the inclined bars 171 into a scrap box on a movable cart 175.

Figure 10:
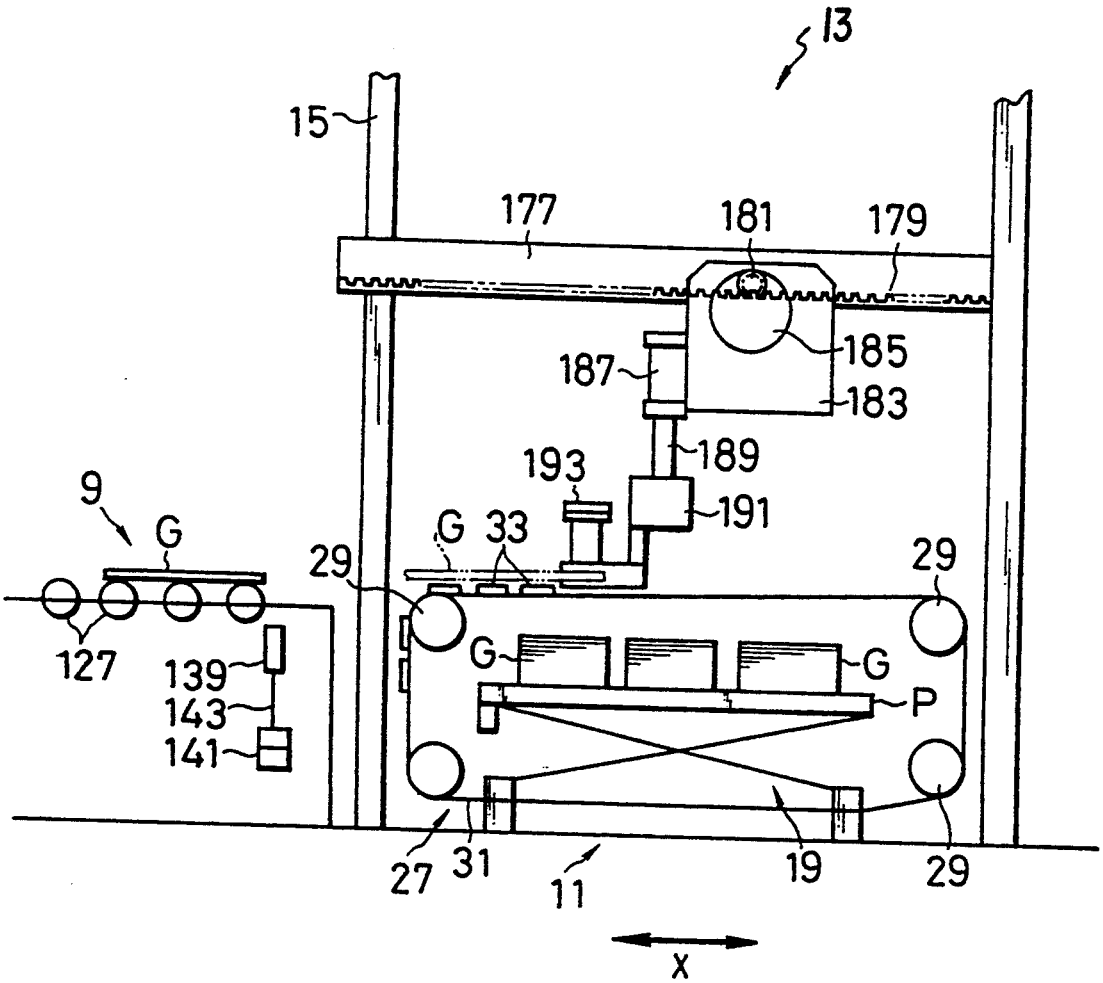
FIG. 10 is an enlarged front view of a part indicated by an arrow X in FIG. 1.

Now referring to FIGS. 1, 2 and 10, the autostorage 13 includes a frame structure 15. The autostorage 13 is quite similar to the autostorage 5 in structures and functions for carrying a pallet P on a lifter 19 to a receiving device 17 disposed on an upper part of the frame structure 15. Therefore, the same reference numerals and letters are used for the same structural and functional elements, and description are omitted about the elements. Here, only different points are explained.

In FIG. 10, the autostorage 13 includes an assorting device 11 for collecting and assorting small product pieces G positioned in the transportation means 9. The assorting device 11 has at least a guide rail 177 mounted on the frame structure 15 and extended in a direction X. The guide rail 177 is provided with a rack 179 extended in the direction X. A carriage 183 is supported by the guide rail 177 through a pinion 181 disposed on the carriage 183 and engaged with the rack 179. The pinion 181 is rotated by a motor 185 mounted on the carriage 183. The motor 185 is preferably a servo motor with an encoder.

The carriage 183 is moved along the guide rail 177 when the motor 185 is driven. A fluid cylinder 187 with a piston rod 189 is fixed to the carriage 183. A lower end of the piston rods 189 is fixed to a stretcher 191 extended in a direction Y to which a plurality of clampers 193 are attached. The clampers 193 are moved in a vertical direction when the cylinder 187 is actuated.

The motor 185 is driven, and the clampers 193 are moved to the left to the small product pieces G positioned on the transportation means 9. Then some clampers 193 so required are actuated to grip the pieces G, and then moved to the right. A part of each of the pieces G (shown in FIG. 10 by an imaginary line) is supported on slats 33 of a slat conveyor 27 which is under operation. The clampers 193 are stopped in a predetermined position above the lifter 19, while the slat conveyor 27 is run successively so that the slats 33 go out of a space above the lifter 19. The position of the clampers 193 is detected by the encoder attached to the motor 185. Then, the clampers 193 are lowered by actuating the cylinder 187, and the pieces G are positioned on the pallet P.

When many pieces G are piled on the pallet P, the pullet is discharged by an elevator 21 (not shown) and carried to a receiving device 17.

Figure 5:
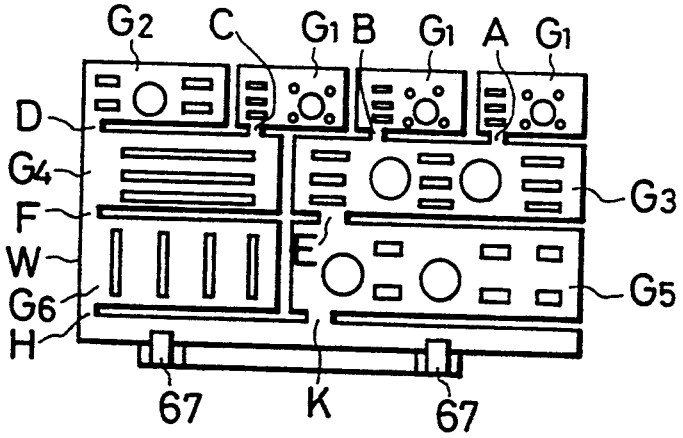
FIG. 5 is a plan of a large work sheet cut with a machine to form many small product parts which are still connected to one another in the sheet through uncut small parts of contour lines of the small product parts.

In FIG. 11, a process for assorting the small product pieces G1, G2, G3, G4, G5, and G6 cut off from a work sheet W shown in FIG. 5 is described.

Figure 11A:
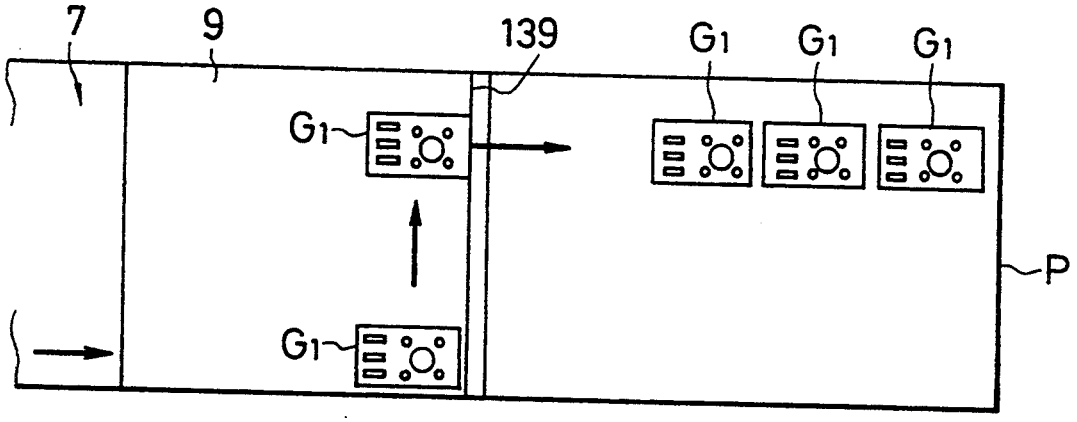
FIGS. 11A–11F are explanatory drawings for showing assortment of many small product pieces on a pallet in a collection device of the system.
Figure 11B:
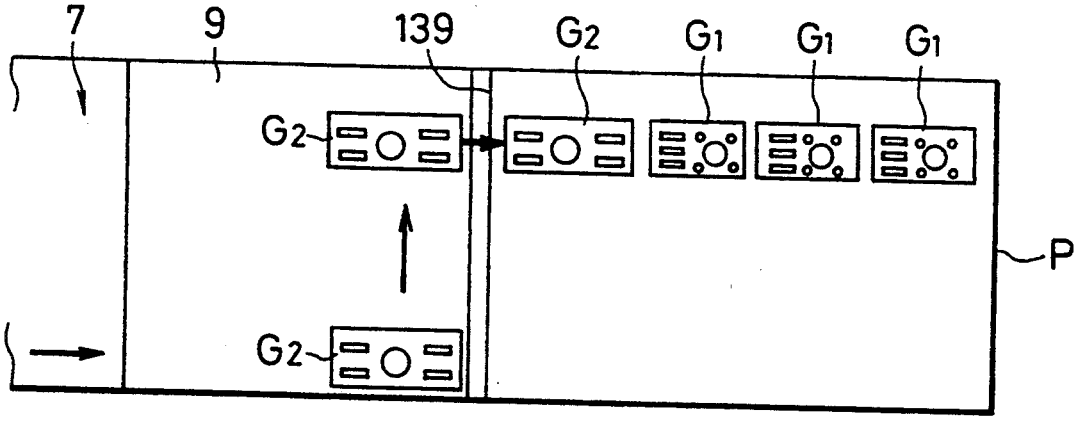
Figure 11C:
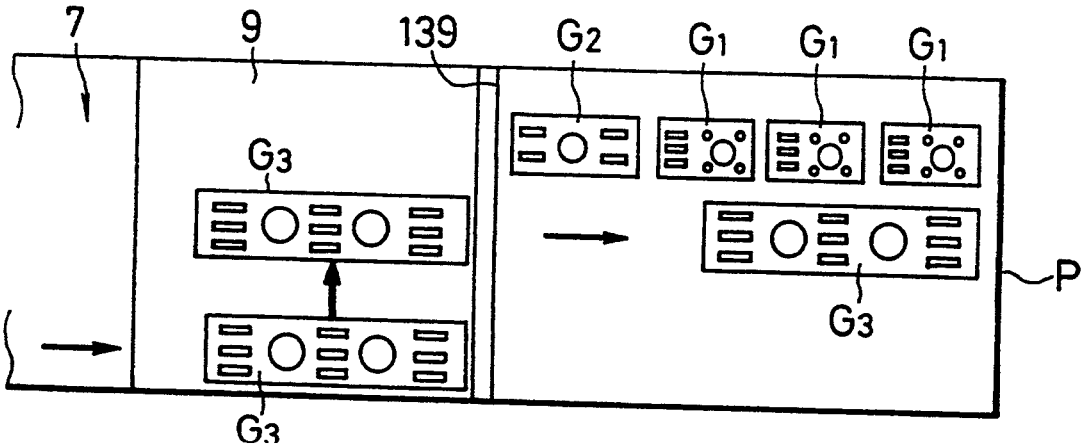
Figure 11D:
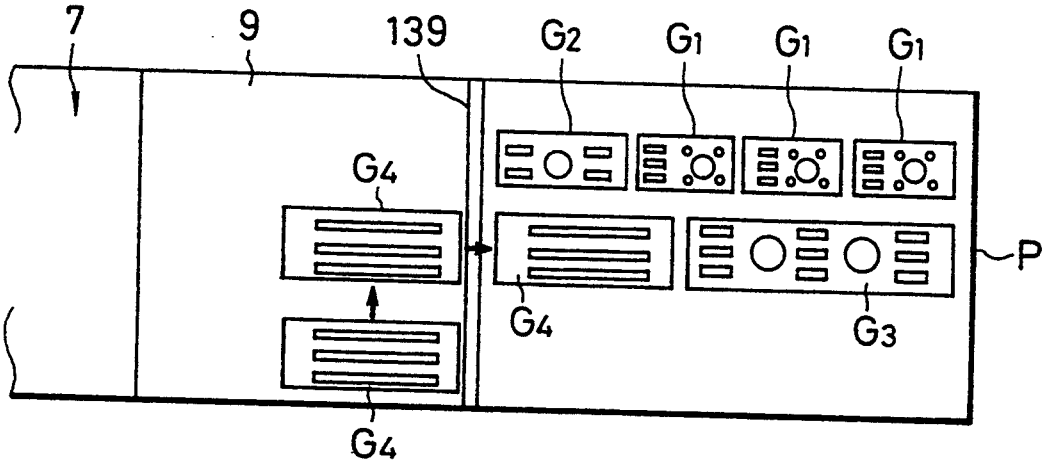

In FIG. 11A, first, three pieces G1 stopped in turn at a frontal right-hand corner of the transportation means 9 by the stopper 139 are moved to a position by the pusher 169 and placed in three positions on the pallet P by the assorting device 11. In FIG. 11B, a piece G2 at the corner is moved to the same position as the G1 and placed in a position on the pallet P. In FIG. 11C, a piece G3 at the corner is moved to a central position on the means 9 and placed in a right-hand central position on the pallet P. In FIG. 11D, a piece G4 at the corner is moved to the central position on the means 9 as the piece G3 and placed on a left-hand central position on the pallet P.

Figure 11E:
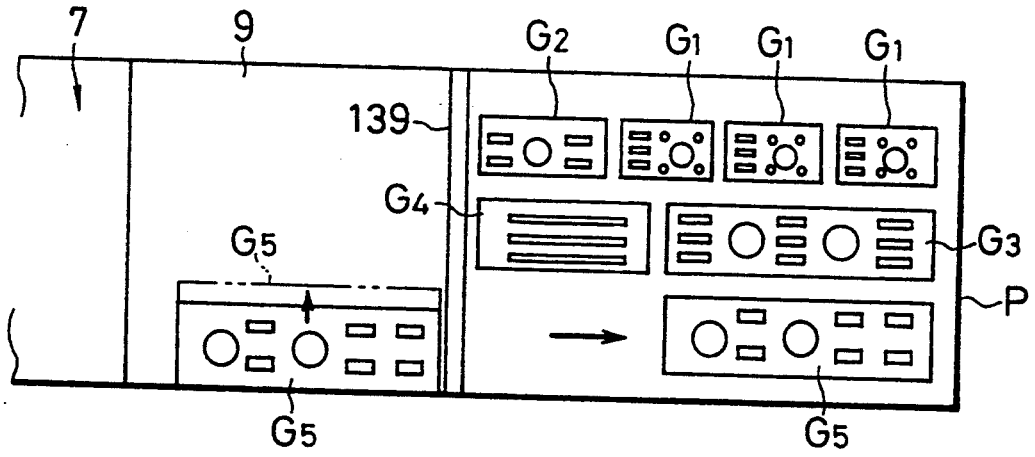
Figure 11F:
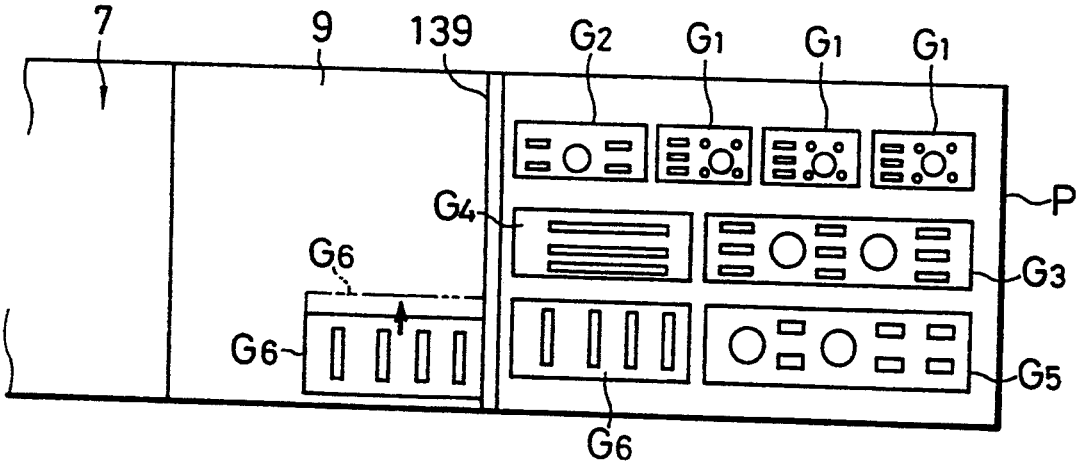

In FIGS. 11E and 11F, two pieces G5 and G6 are finally placed in a right-hand and a left-hand frontal positions on the pallet P respectively. A next group of the pieces G1 to G6 are piled respectively on the same pieces placed on the pallet P.

In the above description, the pieces G are placed on the pallet in the same positions relatively as they were in the sheet. However, the positions may be changed as desired.

As seen from the above description, the pieces G are automatically placed by every kind in the positions on the pallet P. The positions will be changed by controlling and detecting of both the amount of displacement of the piece G in the direction Y on the transportation means 9 and the amount of displacement of the carriage 183 in the direction X by means of encoders.

In the present invention, processes from introducing of material sheets W to assorting of many product pieces G cut off from the sheets W are carried out automatically, and the pieces G are assorted by every kind. In addition, the product pieces G are piled on a pallet, and therefore, storage space for the pieces is reduced.

This invention is not limited to the embodiment described above, and is carried out in modified embodiments. For example, the cutting-off device 71 may be separated from the turret punch press 1 and installed on the floor independently. A laser beam processing machine may be used instead of the turret punch press 1 for cutting the work sheet W to form many small product parts G.

I claim:

1. A method for assorting small product parts cut off from worksheets comprising the steps of:

cutting a worksheet by a cutting machine to form a plurality of and several kinds of small product parts which are connected to said worksheet through remaining small uncut parts of contour lines of said small product parts;

cutting said remaining small uncut parts of said contour lines of said small product parts one-by-one;

passing each of said small product parts cut off from said worksheet in a direction X to transportation means disposed adjacent to said cutting machine, one-by-one immediately after each of said small product parts is cut;

transporting one-by-one said small product parts in said X direction and positioning one-by-one said small product parts in desired places with respect to a Y direction perpendicular to said X direction by said transportation means thereon;

gripping one-by-one said small product parts at said desired places by movable clampers and moving said clampers towards desired positions; and placing one-by-one said product parts onto said desired positions by moving said clampers.

2. The method of claim 1, wherein said small product parts are positioned in accordance with said every kind in said desired places on said transportation means.

3. The method of claim 2, wherein said small product parts positioned in accordance with said every kind in said desired places are moved in said X direction by said clampers to be placed onto said desired positions which are arranged the same as is originally formed in said worksheet.

4. A method for assorting small product parts cut off from worksheets comprising the steps of:

(a) cutting a worksheet by a cutting machine to form a plurality of and several kinds of small product parts which are connected to said worksheet through remaining small uncut parts of contour lines of said small product parts; said worksheet having a front edge and an upstream edge and each said small product part having a front edge and an upstream edge, said front edges of said worksheet and said small product parts separated by a distance and said upstream edges of said worksheet and said small product part separated by a distance;

(b) separating a small product part from a worksheet by cutting off the uncut part, each uncut part cut off one-by-one;

(c) moving each said small product part one-by-one in a first direction (Y) by a pusher through a distance substantially equal to the distance from the front edge of worksheet to the front edge of the small product part;

(d) moving each said small product part one-by-one in a second direction (X) perpendicular to the first direction (Y) by a clamper through a distance substantially equal to the distance from the upstream edge of worksheet to the upstream edge of the small product part; and (e) repeating the steps (b) through (d) for each small product part separated from the worksheet.

5. A system for assorting a number of small product parts cut off from worksheets, used for a cutting machine for cutting a worksheet to form a plurality of small product parts which are connected to said worksheet through remaining small uncut parts of contour lines of said small product parts, comprising:

a cutting-off device for cutting said remaining small uncut parts one-by-one;

transportation means disposed adjacent to said cutting-off device for carrying small product parts one-by-one cut off from said worksheet in a direction X immediately after each said small product part is cut and for positioning each of said small product parts one-by-one in desired places thereon with respect to a Y direction perpendicular to said X direction; and an assorting device having horizontally and vertically movable clamps for gripping said small product parts one-by-one at said desired places and positioning by horizontally and vertically moving said small product parts one-by-one in desired positions.

6. The system of claim 5, wherein the transportation means are able to position said small product parts in said desired places which are disposed in a Y direction in accordance with every kind of small product part.

7. The system of claim 6, wherein said transportation means includes a pusher for pushing said small product parts to said desired places disposed in said Y direction.

8. The system of claim 6, wherein said assorting device moves said small product parts, which are positioned in said desired places disposed in said Y direction, in said X direction to said desired positions, whereby said small product parts are assorted in an arrangement the same as is originally formed in said worksheet.

* * * * *